United States Patent [19]

Coyne

[11] 4,359,877

[45] Nov. 23, 1982

[54] HEAT PUMP COIL CIRCUIT

[75] Inventor: Gerard G. Coyne, Tyler, Tex.

[73] Assignee: General Electric Company, Louisville, Ky.

[21] Appl. No.: 262,250

[22] Filed: May 11, 1981

[51] Int. Cl.[3] ..... F25B 47/00

[52] U.S. Cl. ..... 62/278; 62/324.1; 62/324.6

[58] Field of Search ..... 62/160, 324.1, 324.6, 62/324.7, 278

[56] References Cited

U.S. PATENT DOCUMENTS

| | | | |
|---|---|---|---|
| 2,806,674 | 9/1957 | Biehn | 62/160 |
| 4,057,977 | 11/1977 | Chambless | 62/324.1 |
| 4,171,622 | 10/1979 | Yamaguchi et al. | 62/324.1 |
| 4,182,133 | 1/1980 | Haas et al. | 62/160 X |
| 4,240,269 | 12/1980 | Bussjager | 62/324.6 |
| 4,313,313 | 2/1982 | Chrastowski et al. | 62/278 |

*Primary Examiner*—Lloyd L. King

*Attorney, Agent, or Firm*—Frank P. Giacalone; Radford M. Reams

[57] ABSTRACT

An outdoor heat exchanger for use in a reverse cycle refrigeration system wherein refrigerant is directed to the lower portion of the heat exchanger when it functions as the system condenser as during defrost operation.

5 Claims, 3 Drawing Figures

HEAT PUMP COIL CIRCUIT

BACKGROUND OF THE INVENTION

In refrigeration systems of the reverse cycle type, during operation on the heating cycle, a build-up of frost or ice may occur on the system outdoor coil with consequent impairment of system efficiency. To remove accumulated frost or ice from the outdoor coil, a defrost cycle operable to reverse refrigerant flow through the outdoor coil may be initiated. By this means, relatively hot gaseous refrigerant in the system is directed to the outdoor coil to melt frost or ice therefrom.

This build-up of frost or ice on the system outdoor coil during system operation on the heating cycle, and the reversal of the system to remove frost or ice therefrom through initiation of the defrost cycle reduces overall system efficiency. An increase therefore in the ability of the system, when operating in the defrost cycle, to effectively and rapidly remove accumulated frost or ice from the outdoor coil improves overall system efficiency.

In an outdoor coil having one or more rows of finned tubing in a substantially vertical plane, water present on the exterior surfaces of the tubing, for example, water resulting from defrosting of the outdoor coil, tends to pass in a downward direction toward the lower part of the outdoor coil. The tendency of water on the row or rows of finned tubing to move downwardly toward the lower part of the outdoor coil enhances the propensity of the lower part of the outdoor coil to form frost or ice and to accumulate the largest build-up of frost or ice during the system heating cycle operation. The downward flow of water or slush formed during defrost detracts from the melting process near the bottom portions of the outdoor coil.

With the above consideration in mind, it is a principal object of the present invention to provide, in an outdoor coil adapted for use in a reversible refrigeration system, an arrangement effective in directing during the defrost operation the relatively warm gaseous refrigerant to the lower extremities of the heat exchanger.

It is a further object of the invention to improve the ability of the reversible refrigeration system, when operating in the defrost cycle, to remove accumulated frost or ice from the system outdoor coil.

It is a still further object of the present invention to provide, in a reverse cycle refrigeration system, an arrangement operable to pass, during the system defrost cycle, relatively hot refrigerant gas directly to the area of the system outdoor coil normally having the heaviest frost or ice build-up.

SUMMARY OF THE INVENTION

The present invention relates to an outdoor heat exchanger adapted for use in a reverse cycle refrigeration system. The heat exchanger includes a central portion having a plurality of substantially vertically disposed circuits each of which defines a continuous passageway. A defrost circuit having an end portion positioned at each vertical end of the central portion is arranged so that the circuit through each end portion provides a continuous passageway that are connected to form a continuous circuit through the defrost circuit between an inlet and outlet. The circuits are connected to the refrigeration system so that the inlet to the defrost coil is in the lower circuit when the outdoor heat exchanger is functioning as the condenser.

DESCRIPTION OF THE INVENTION

Figure 1:
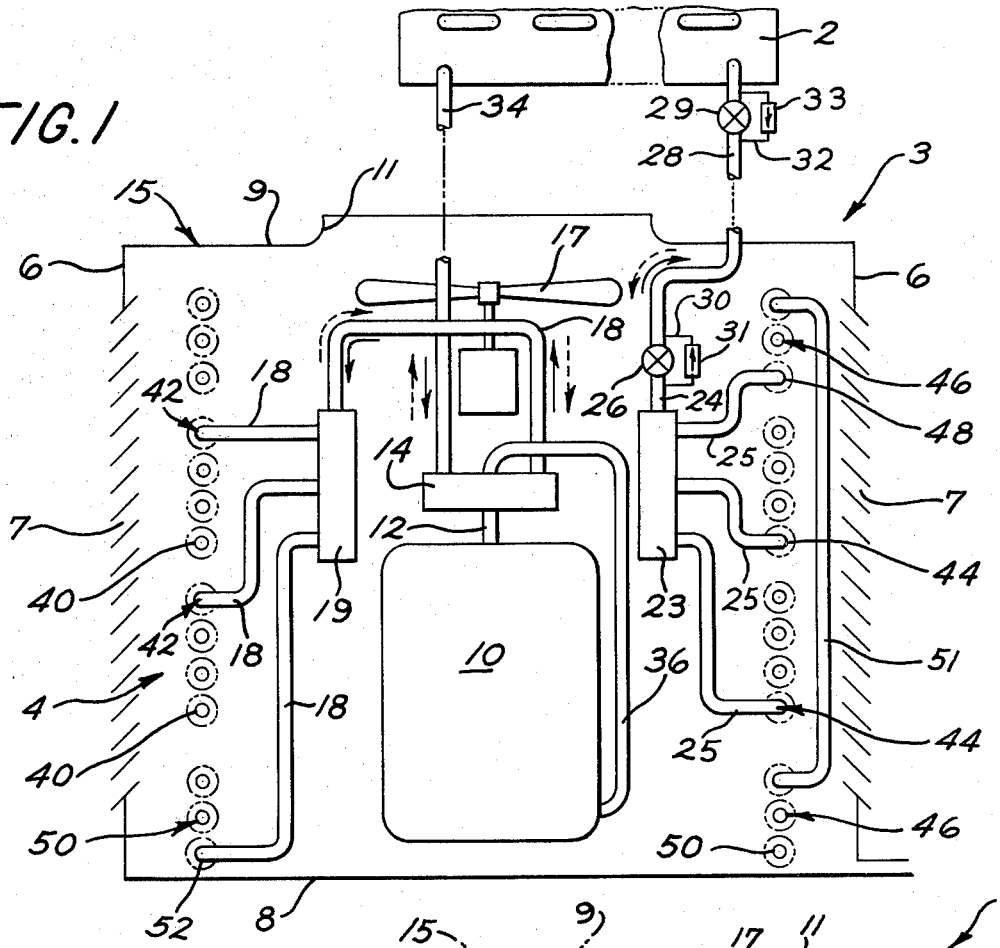
FIG. 1 is a schematic view of a reverse cycle refrigeration heat pump system including a schematic cross sectional elevational view of the outdoor heat exchanger incorporating the present invention.

Referring particularly to FIG. 1 of the drawings, there is shown an air-to-air type heat pump unit employing a refrigeration system operable on the reverse cycle principle. In an apparatus of this type, a first or indoor heat exchange coil 2 is disposed within or in communication with the area to be conditioned and a second outdoor portion 3 including an outdoor heat exchange coil 4 is located within or in communication with the area outside the area to be conditioned, normally the ambient. The outdoor heat exchange coil 4 and various other components of the heat pump unit including the system compressor 10 and reversing valve 14 are normally enclosed by a casing or housing 15. In order to control the flow of refrigerant from one heat exchanger to the other and to provide the desired pressure differential between the two heat exchangers, there is provided a heating cycle flow control restricting or expansion means 26 connected to the outdoor coil 4 and a cooling expansion means 29 connected to the indoor coil 2, the two expansion means being connected by conduit 28. Each of the expansion means has associated therewith a bypass line for bypassing the expansion means during operation of the system on one of the cycles. More specifically, the heating expansion means 26 is provided with a bypass line 30 including a check valve 31 which permits the flow of condensed refrigerant through the bypass line into the conduit 28 during cooling while the cooling expansion means 29 is provided with a bypass line 32 including a check valve 33 for permitting flow of condensed refrigerant through the bypass line during heating cycle. By this arrangement of the expansion means and bypass lines, it will be seen that the conduit 28 connecting the two expansion means 28 and 29 is always part of the high pressure side of the system regardless of whether the system is operating on the cooling or heating cycle and is therefore conveying condensed refrigerant at the pressure of the heat exchanger functioning as the condenser.

In reducing the present invention to practice, the outdoor heat exchanger 4 was of the spirally wound single pass spine fin heat exchange tubing type. As will be explained fully hereinafter, the various circuits making up the outdoor heat exchanger are formed by cutting the single wound spiral and appropriately connecting the cut ends to form the desired circuits. The coil is enclosed in the housing 15 which is substantially rectangular and includes side walls 6 each provided with intake openings 7, a base or drain pan 8 and a top 9 having a discharge opening 11. In this type arrangement the compressor 10 and reversing valve 14 are normally positioned in the outdoor portion 3 generally as shown in FIG. 1 within the spirally wound coil 4. The compressor 10 discharges relatively hot gaseous refrigerant through discharge line 12 to the four-way reversing valve 14. Valve 14, selectively operable by suitable means (not shown), reverses refrigerant flow through a portion of the refrigeration system in order to obtain the desired heating or cooling effects.

From the reversing valve 14, hot gaseous refrigerant flows during the cooling cycle operation, illustrated by the solid line arrows, through lines 18 to the outdoor heat exchange coil 4. Ambient air passed over the surface of coil 4 by suitable fan means 17 effects condensation of the gaseous refrigerant passing through the outdoor coil. The liquid refrigerant formed in the heat exchange coil 4 flows through line 24, bypass line 31 and line 28 to the indoor expansion means 29 which provides the requisite pressure drop between the indoor and outdoor heat exchange coils in the refrigeration system.

The refrigerant thereafter flows to the indoor heat exchange coil 2 serving, during the cooling cycle, as an evaporator. Refrigerant passing through the indoor coil 2 is converted into gaseous refrigerant as it extracts heat from the stream of air flowing over the indoor coil under the influence of suitable fan means (not shown). The gaseous refrigerant thereafter passes through line 34 to the reversing valve 14 and thereafter through the compressor suction line 36 to the compressor 10 to complete the refrigerant flow cycle.

In operation of the heat pump described, the reversing valve 14 may be actuated to place line 12 in communication with the indoor heat exchange coil 2 and line 36 in communication with the outdoor heat exchange coil 4 when it is desired to operate the unit in the heating cycle. The dotted line arrows illustrate the direction of refrigerant flow during the heating cycle. Under these circumstances, heat from the refrigerant flowing in the indoor coil is rejected to the stream of air flowing thereover. The rejection of heat from the refrigerant converts the gaseous refrigerant to liquid refrigerant which flows through bypass check valve 33 to the expansion means 26 to the outdoor coil 4 now functioning as an evaporator. The gaseous refrigerant created in the outdoor coil as a result of the heat transferred between the refrigerant and the ambient air passing thereover flows through lines 18 to reversing valve 14 to the compressor 10.

During the heating cycle, with the outdoor coil functioning as the system evaporator, ambient outdoor temperatures may be such that the coil temperature is below freezing which results in frost or ice build-up on the coil. This frost or ice has an insulating effect and blocks air from passing through the coil. This build-up of frost or ice must be removed to obtain efficient refrigeration operation. For this purpose, defrosting is periodically effected by reversing the system so that hot gaseous refrigerant is directed to the outdoor coil during which time the accumulated frost or ice melts and runs down and off the fins and coils. In certain frost or ice conditions, all of the frost may not clear the heat exchanger coil before the cycle of operation is returned to the heating mode. This generally results in frost or ice build-up in the lower portions of the coil that are not removed for long periods of ambient conditions during which the efficiency of the system is adversely affected. In some cases, there is evidence that this coldest portion of the refrigerant system condenses and collects a large portion of the refrigerant charge. This tends to cause the system to operate in a near equilibrium condition and not build up temperatures sufficient to terminate the defrost cycle for excessive periods of time.

By the present invention, the effectiveness of the system defrost is enhanced since applicant's coil construction serves to pass, during the system defrost cycle, a portion of the relatively hot gaseous refrigerant from the compressor is fed directly to the lower portion of the coil, the area when the heaviest build-up of frost or ice normally occurs.

Figure 2:
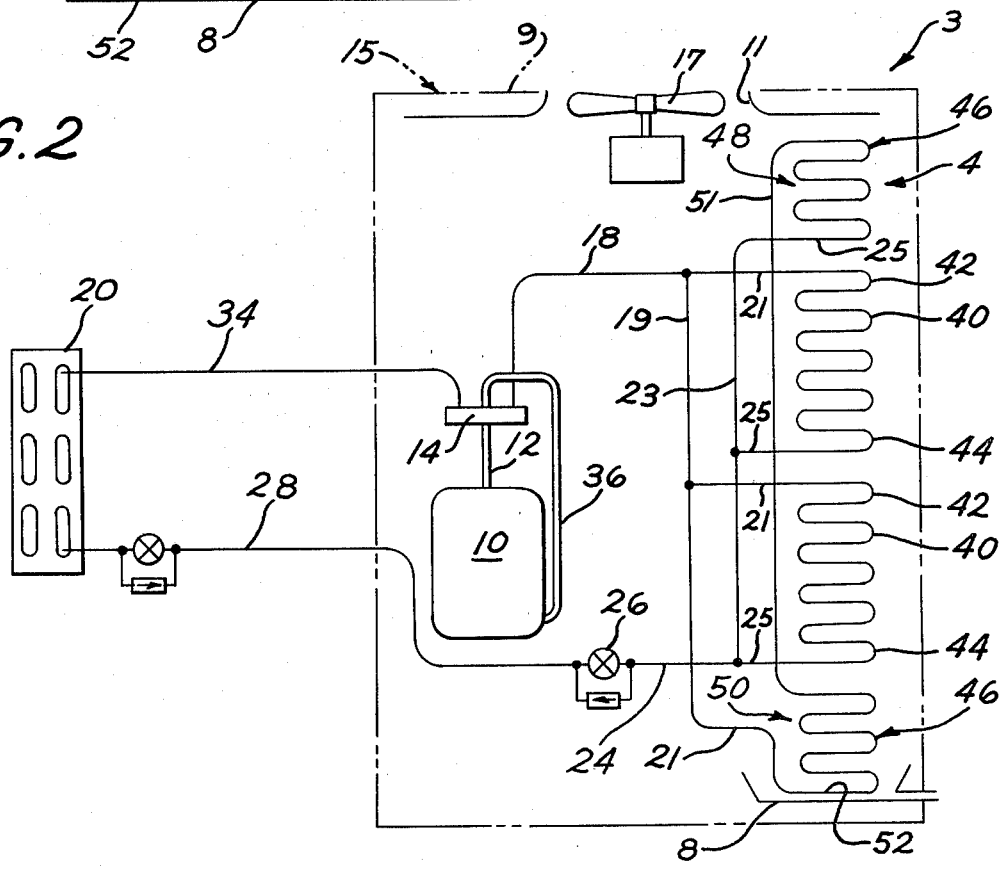
FIG. 2 is a schematic view of the refrigeration system of FIG. 1.

Referring to FIGS. 1 & 2 of the drawing, the spirally wound outdoor heat exchanger coil 4 comprises a plurality of vertically disposed circuits 40. Each circuit is connected to be in a parallel flow arrangement between lines 18 and 24 with the inlet and outlet being interchangeable depending on the direction of refrigerant flow. For example, when the outdoor coil is functioning as the system condenser, refrigerant from the system line 18 enters the upper portion 42 of each circuit 40 through a header 19, and is discharged into a line 25 in the lower portion 44 of each circuit and through a header 23 into line 24. It should be noted that while each circuit presents a single series flow between inlet and outlet, the circuits are connected in parallel relative to refrigerant flow from lines 18 and 24. In carrying out the present invention of directing a portion of relatively hot gaseous refrigerant directly to the lower portion of the outdoor heat exchanger 4, a split defrost heat exchange circuit 46 is provided. Circuit 46 includes a first circuit or section 48 arranged above the vertically disposed circuits 40 and a second circuit or section 50 arranged below the vertically disposed circuits 40. The circuits 48 and 50 are interconnected by line 51 to form the single circuit 46 that is in parallel flow arrangement with the circuits 40 between lines 18 and 24 with inlet and outlet being interchangeable between the upper and lower circuits depending on the direction of refrigerant flow. Refrigerant flow through circuit 46 is in parallel with circuits 40. When the outdoor coil is functioning as the system condenser, hot gaseous refrigerant from the system line 18 enters the lower portion 52 of circuit 50 passing the relatively hot superheated or saturated refrigerant directly into the lower circuit 50 that sees the colder frost draining from above. The condensed cooler refrigerant then flows through the interconnecting line 51 and to the upper circuit 48 where it is not subjected to the same cold drainage environment of lower section and then to the system line 24.

In this arrangement, when hot gaseous refrigerant is directed by valve 14 through line 18 to cause the outdoor coil to function as the condenser, a portion of the hot gaseous refrigerant is fed directly into the lowermost portion of the heat exchanger circuit 50 and the condensed refrigerant is then circuited to the upper section 48 which does not receive the drainage of water and slush.

In operation, the hot gaseous refrigerant entering the lower circuit 50 effectively melts frost when present thereon. The length of the lower circuit 50 is such that the temperature of all its surfaces is above freezing so that as the refrigerant condenses and cools in split circuit 46, all of the sub-cooling takes place in the upper circuit 48.

Figure 3:
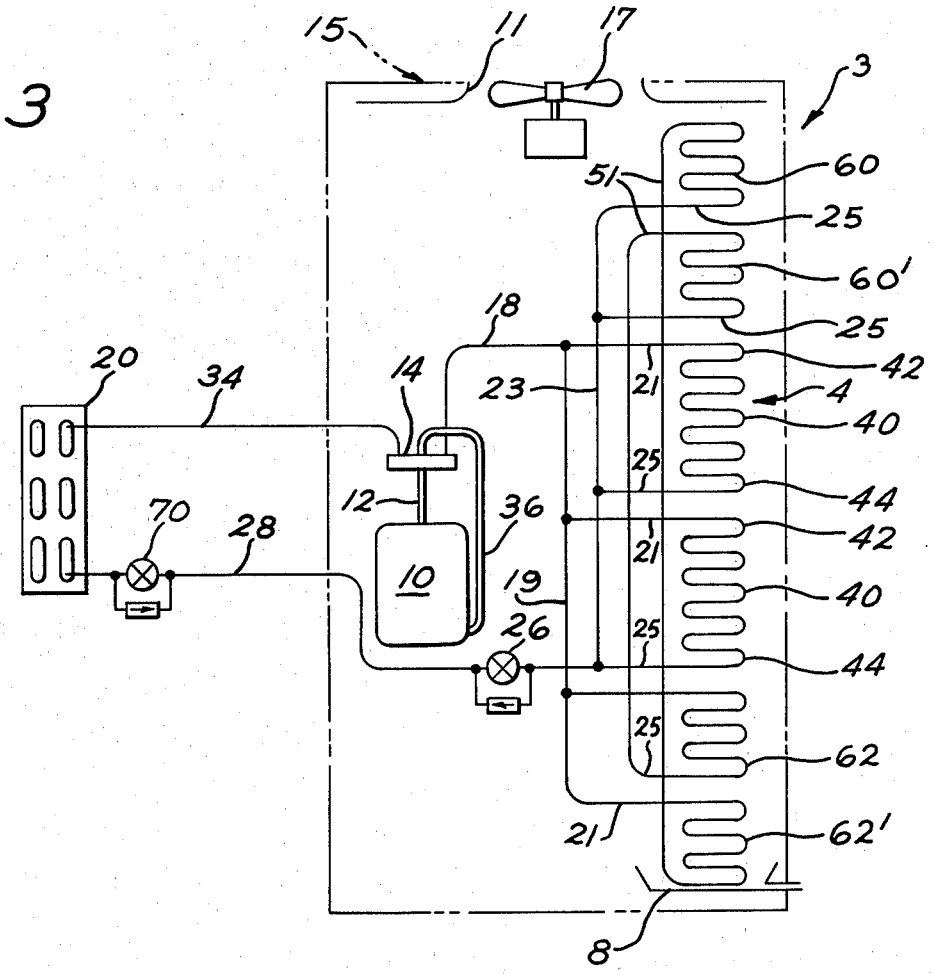
FIG. 3 is a view similar to FIG. 2 showing another embodiment of the invention.

Referring to FIG. 3, there is shown another embodiment of the invention wherein similar components of the system are designated with the same reference numerals used in the embodiment of FIG. 1. In this instance, the hot gaseous refrigerant from line 18 is directed to two lower defrost circuits rather than the single circuit 46.

Since the frost buildup is from the base pan up, in some instances it may be necessary to increase the height of the heat exchange area receiving the hot refrigerant.

Accordingly, in the modification illustrated in FIG. 3 of the drawing wherein like numerals refer to like parts, the split defrost heat exchange circuit 46 includes two circuits 60 and 60' in the upper portion and 62 and 62' in the lower portion. In this instance, when the outdoor coil is functioning as the system condenser, hot gaseous refrigerant from the system line 18 enters simultaneously the upper portion of both circuits 62 and 62'. This arrangement directs the relatively hot gaseous refrigerant to two points of the lower extremities of outdoor heat exchanger 4 thereby increasing the area being defrosted. It should be noted that alternatively the hot gaseous refrigerant may be directed to the lower portions of the defrost circuits as disclosed in the embodiment of FIGS. 1 and 2.

The foregoing is a description of the preferred embodiment of the apparatus of the invention and it should be understood that variations may be made thereto without departing from the true spirit of the invention as defined in the appended claims.

I claim:

1. An outdoor heat exchanger coil for use in a reverse cycle refrigeration system including a motor compressor, an indoor heat exchanger, a valve for reversing the flow of refrigerant through said system to operate said system in a cooling defrost mode or a heating mode with each of said heat exchangers arranged interchangeably as a condenser or as an evaporator said outdoor heat exchanger comprising:

A central portion including a plurality of substantially vertically disposed central circuits of spine fin heat exchange tubing, each of said circuits defining a single continuous passageway between a first opening connected to said reversing valve and a second opening connected to the system liquid line;

a split circuit including a lower circuit arranged below said vertically disposed central circuits and an upper circuit arranged above said vertically disposed central circuits, means interconnecting said lower and upper circuit in series refrigerant flow to define a single continuous passageway between a first opening in said lower section and a second opening in the upper circuit of said split circuit;

conduit means including a first refrigerant line connecting said first opening in said lower circuit of said split circuit to the system reversing valve and a second refrigerant line connecting said second opening to the system liquid line whereby a portion of relatively warm gaseous refrigerant is fed from said compressor through said reversing valve directly to said lower circuit of said split circuit through said first opening when the system is in the defrost mode, and for directing a portion of liquid refrigerant from said system liquid line directly to said upper circuit of said split circuit through said second opening when the system is in the heating mode.

2. A spirally wound spine fin outdoor heat exchanger coil for use in a reverse cycle refrigeration system including a motor compressor, an indoor heat exchanger, a valve for reversing the flow of refrigerant through said system to operate said system in a cooling defrost mode or a heating mode with each of said heat exchangers arranged interchangeably as a condenser or as an evaporator said outdoor heat exchanger comprising:

a central portion including a plurality of spirally wound substantially vertically disposed central circuits of spine fin heat exchange tubing, each of said circuits defining a single continuous passageway between a first opening connected to said reversing valve and a second opening connected to the system liquid line;

a split circuit including a lower circuit arranged below said vertically disposed central circuits and an upper circuit arranged above said vertically disposed central circuits, means interconnecting said lower and upper circuits in series refrigerant flow to define a single continuous passageway between a first opening in said lower section and a second opening in the upper circuit of said split circuit;

conduit means including a first refrigerant line connecting said first opening in said lower circuit of said split circuit to the system reversing valve and a second refrigerant line connecting said second opening to the system liquid line whereby a portion of relatively warm gaseous refrigerant is fed from said compressor through said reversing valve directly to said lower circuit of said split circuit through said first opening when the system is in the defrost mode, and for directing a portion of liquid refrigerant from said system liquid line directly to said upper circuit of said split circuit through said second opening when the system is in the heating mode.

3. The outdoor heat exchanger defined in claim 2 further including means connecting all of said circuits in parallel to said refrigerator system to provide refrigerant flow between the first and second openings simultaneously through all of said circuits.

4. An outdoor heat exchange apparatus adapted for use in a reverse cycle refrigeration system including a motor compressor, an indoor heat exchanger, a valve for reversing the flow of refrigerant through said system to operate said system in a cooling defrost mode or a heating mode with each of the heat exchangers arranged interchangeably as a condenser or as an evaporator, said outdoor heat exchange apparatus comprising:

a housing including a base drain member, side walls having air intake openings and a top wall having discharge openings;

fan means arranged in said housing for directing outdoor ambient air between said air intake and discharge openings;

a heat exchange tubing having its lowest pass arranged adjacent said base pan member extending vertically substantially parallel to said side wall intake openings so as to be in the path of air passing between said intake and discharge openings;

a central portion of said heat exchange tubing including a plurality of substantially vertically disposed central circuits of heat exchange tubing, each of said circuits defining a single continuous passageway between first opening connected to said reversing valve and second opening connected to the system liquid line;

a split circuit of said heat exchange tubing including a lower circuit arranged below said vertically disposed central circuits and an upper circuit arranged above said vertically disposed central circuits, means interconnecting said lower and upper circuits in series refrigerant flow to define a single continuous passageway between a first opening in said lower section and a second opening in the upper circuit of said split circuit;

conduit means including a first refrigerant line connecting said first opening in said lower circuit of said split circuit to the system reversing valve and a second refrigerant line connecting said second opening to the system liquid line whereby a portion of relatively warm gaseous refrigerant is fed from said compressor through said reversing valve directly to said lower circuit of said split circuit through said first opening when the system is in the defrost mode, and for directing a portion of liquid refrigerant from said system liquid line directly to said upper circuit of said split circuit through said second opening when the system is in the heating mode.

5. An outdoor heat exchange apparatus adapted for use in a reverse cycle refrigeration system including a motor compressor, an indoor heat exchanger, a valve for reversing the flow of refrigerant through said system to operate said system in a cooling defrost mode or a heating mode with each of the heat exchangers arranged interchangeably as a condenser or as an evaporator, said outdoor heat exchanger apparatus comprising:

a housing including a base drain member, said walls having air intake openings and a top wall having discharge openings;

fan means arranged in said housing for directing outdoor ambient air between said air intake and discharge openings;

a spirally wound single pass spine fin heat exchange tubing having its lowest pass arranged adjacent said base pan member extending vertically substantially parallel to said side wall intake openings so as to be in the path of air passing between said intake and discharge openings;

a central portion of said spirally wound heat exchange tubing including a plurality of spirally wound substantially vertically disposed central circuits of spine fin heat exchange tubing, each of said circuits defining a single continuous passageway between first opening connected to said reversing valve and second opening connected to the system liquid line;

a split circuit of said spirally wound heat exchange tubing including a lower circuit arranged below said vertically disposed central circuits and an upper circuit arranged above said vertically disposed central circuits, means interconnecting said lower and upper circuits in series refrigerant flow to define a single continuous passageway between a first opening in said lower section and a second opening in the upper circuit of said split circuit;

conduit means including a first refrigerant line connecting said first opening in said lower circuit of said split circuit to the system reversing valve and a second refrigerant line connecting said second opening to the system liquid line whereby a portion of relatively warm gaseous refrigerant is fed from said compressor through said reversing valve directly to said lower circuit of said split circuit through said first opening when the system is in the defrost mode, and for directing a portion of liquid refrigerant from said system liquid line directly to said upper circuit of said split circuit through said second opening when the system is in the heating mode.

* * * * *